US006904708B2

(12) United States Patent
Rogers

(10) Patent No.: US 6,904,708 B2
(45) Date of Patent: Jun. 14, 2005

(54) SNOW REMOVAL SYSTEM

(76) Inventor: Gary A. Rogers, 890 Sands La., Camano Island, WA (US) 98282

( * ) Notice: Subject to any disclaimer, the term of this patent is extended or adjusted under 35 U.S.C. 154(b) by 0 days.

(21) Appl. No.: 10/449,845

(22) Filed: May 29, 2003

(65) Prior Publication Data

US 2004/0074114 A1 Apr. 22, 2004

Related U.S. Application Data

(60) Provisional application No. 60/384,714, filed on May 29, 2002.

(51) Int. Cl.[7] ..... E01H 5/10

(52) U.S. Cl. ..... 37/228; 37/227; 37/219; 126/343.5 R

(58) Field of Search ..... 37/228, 219, 223, 37/226, 227, 229; 126/343.5 R

(56) References Cited

U.S. PATENT DOCUMENTS

| | | | | | |
|---|---|---|---|---|---|
| 1,160,205 | A | * | 11/1915 | Smith | 126/343.5 R |
| 1,388,027 | A | * | 8/1921 | Connolly | 126/343.5 R |
| 1,602,476 | A | * | 10/1926 | Ballard | 126/343.5 R |
| 1,821,292 | A | * | 9/1931 | Chase | 126/343.5 R |
| 2,599,098 | A | | 6/1952 | Flynn | |
| 2,602,443 | A | | 7/1952 | Leary | |
| 2,605,760 | A | | 8/1952 | Cayas | |
| 3,166,066 | A | * | 1/1965 | Dunn et al. | 126/343.5 R |
| 3,171,405 | A | | 3/1965 | Miller | |
| 3,309,798 | A | | 3/1967 | Devlin et al. | |
| 3,452,459 | A | * | 7/1969 | Campion | 37/229 |
| 3,464,128 | A | * | 9/1969 | Krickovich | 37/228 |
| 3,484,961 | A | | 12/1969 | Coslowsky | |
| 3,619,918 | A | | 11/1971 | Morin | |
| 4,071,966 | A | | 2/1978 | Cohen | |
| 4,353,176 | A | * | 10/1982 | Hess | 37/228 |
| 4,409,957 | A | * | 10/1983 | Muhammad | 126/343.5 R |
| 4,785,561 | A | * | 11/1988 | Swanson | 37/197 |
| 5,235,762 | A | * | 8/1993 | Brady | 37/228 |
| 5,561,921 | A | * | 10/1996 | Vanderlinden | 37/227 |
| 5,588,231 | A | | 12/1996 | Mavrianos | |
| 5,956,872 | A | | 9/1999 | Mavrianos | |

FOREIGN PATENT DOCUMENTS

| | | | |
|---|---|---|---|
| JP | 02066202 | * | 3/1990 |
| JP | 02035108 | * | 2/1999 |

* cited by examiner

*Primary Examiner*—Robert E. Pezzuto
*Assistant Examiner*—Thomas A. Beach
(74) *Attorney, Agent, or Firm*—Christensen O'Connor Johnson Kindness PLLC

(57) ABSTRACT

A snow removal system (100) for melting snow into water includes a container (110) having a storage chamber (124) adapted to store snow and a predetermined amount of water (114). The snow removal system also includes a heating assembly (104) at least partially disposed in the storage chamber and adapted to heat water stored in the storage chamber to a selected temperature. The snow removal system further includes a mixing system (106) adapted to pressurize water and discharge the pressurized water through at least one nozzle (168). The nozzle is oriented to direct the pressurized water into the storage chamber. A method of snow removal whereby the snow removal system (100) is used to mix snow with heated water by spraying of pressurized water.

33 Claims, 3 Drawing Sheets

SNOW REMOVAL SYSTEM

CROSS-REFERENCE TO A RELATED APPLICATION

This application claims the benefit of U.S. Provisional Patent Application No. 60/384,714, filed May 29, 2002, the disclosure of which is hereby expressly incorporated by reference and priority from the filing date of which is hereby claimed under 35 U.S.C. § 119.

FIELD OF THE INVENTION

The present invention relates to snow removal and more particularly, to snow removal systems for melting snow.

BACKGROUND OF THE INVENTION

Snow removal is a time consuming, labor intensive, and equipment intensive process. Accordingly, snow removal is a very expensive endeavor for communities of all sizes and populations, especially those communities located in northern tier states and provinces. The large equipment and labor costs involved in snow removal divert large portions of municipal, state, and Federal budgets and results in increased taxes.

Traditional methods of snow removal include plowing newly fallen snow into rows. The rows of snow are then either plowed to the side of the road or delivered to a dump site via graders, front-end loaders and dump trucks. This process is very time consuming, inefficient, and costly. In areas of dense housing, the difficulty of snow removal is significantly increased. For instance, with regard to the roads and parking lots serving high density areas typified by multi-family dwellings and commercial buildings, the snow removal vehicle must maneuver in relatively confined areas, which in turn requires a smaller sized and less efficient snow removal device. Further, the collected snow is often stored on site, eliminating the use of numerous parking stalls.

Some previously developed snow removal systems have attempted to address the problem of snow storage by melting the collected snow into water. Often the snow is loaded into a tank having a heating device disposed therein. The heat generated by the heating device is used to heat and convert the snow into a liquid having a fraction of the volume of the collected snow. The water is then disposed of, often by discharging the water to a storm drain. Although somewhat effective, previously developed snow removal systems are not without their problems. For instance, it has been found that the systems fail to mix the collected snow into the tank of heated water. This results in inefficiencies in the snow melting process, resulting in an increased rate of energy consumption and a decrease in the snow melting capacity of the snow removal system.

In some previously developed snow removal systems, a snow blower is attached to a duct. It has been discovered that under some conditions, such as when the temperature drops to near freezing or below, the duct of the snow blower can become clogged with snow, at least decreasing the efficiency of the snow blower and most often leading to the duct becoming fully obstructed, halting snow removal operations all together.

In other previously developed snow removal systems, the heat contained in a combustion heating source is discharged through an exhaust pipe. The exhaust pipe is not oriented to pass through the heated water, thus a significant amount of heat contained in the exhaust gases is discharged out the stack and not used for snow heating purposes. Thus, the thermal efficiency of the system is not maximized.

Thus, there exists a need for a snow removal system that is maneuverable, eliminates the need for snow storage, efficiently heats and mixes collected snow, is easily manufactured, reliable, inexpensive to manufacture and operate, and meets or exceeds the performance requirements of the end user.

SUMMARY OF THE INVENTION

One embodiment of a snow removal system formed in accordance with the present invention is provided. The snow removal system is operable to melt snow into water and includes a container having a storage chamber adapted to store snow and a predetermined amount of water. The snow removal system also includes a heating assembly at least partially disposed in the storage chamber and adapted to heat water stored in the storage chamber to a selected temperature. The snow removal system further includes a mixing system adapted to pressurize water and discharge the pressurized water through at least one nozzle, the nozzle oriented to direct the pressurized water into the storage chamber.

An alternate embodiment of a snow removal system formed in accordance with the present invention is provided. The snow removal system is adapted to collect and melt snow into water. The snow removal system includes snow collecting means for collecting snow from a ground surface and conveying the collected snow to a storage chamber adapted to store the collected snow and water produced from melted snow. The snow removal system also includes heating means at least partially disposed in the storage chamber for heating any contents of the storage chamber. The snow removal system further includes mixing means for mixing the contents of the storage chamber by discharging pressurized water into the storage chamber.

One method of snow removal performed in accordance with the present invention is provided. The method includes collecting snow from a ground surface and discharging the collected snow into a container containing heated water therein. The method also includes mixing the collected snow with the heated water in the container by discharging pressurized water into the container to mix the heated water and collected snow to assist in melting the collected snow.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

FIGS. 1–4 illustrate one embodiment of a snow removal system 100 formed in accordance with the present invention.

Figure 1:
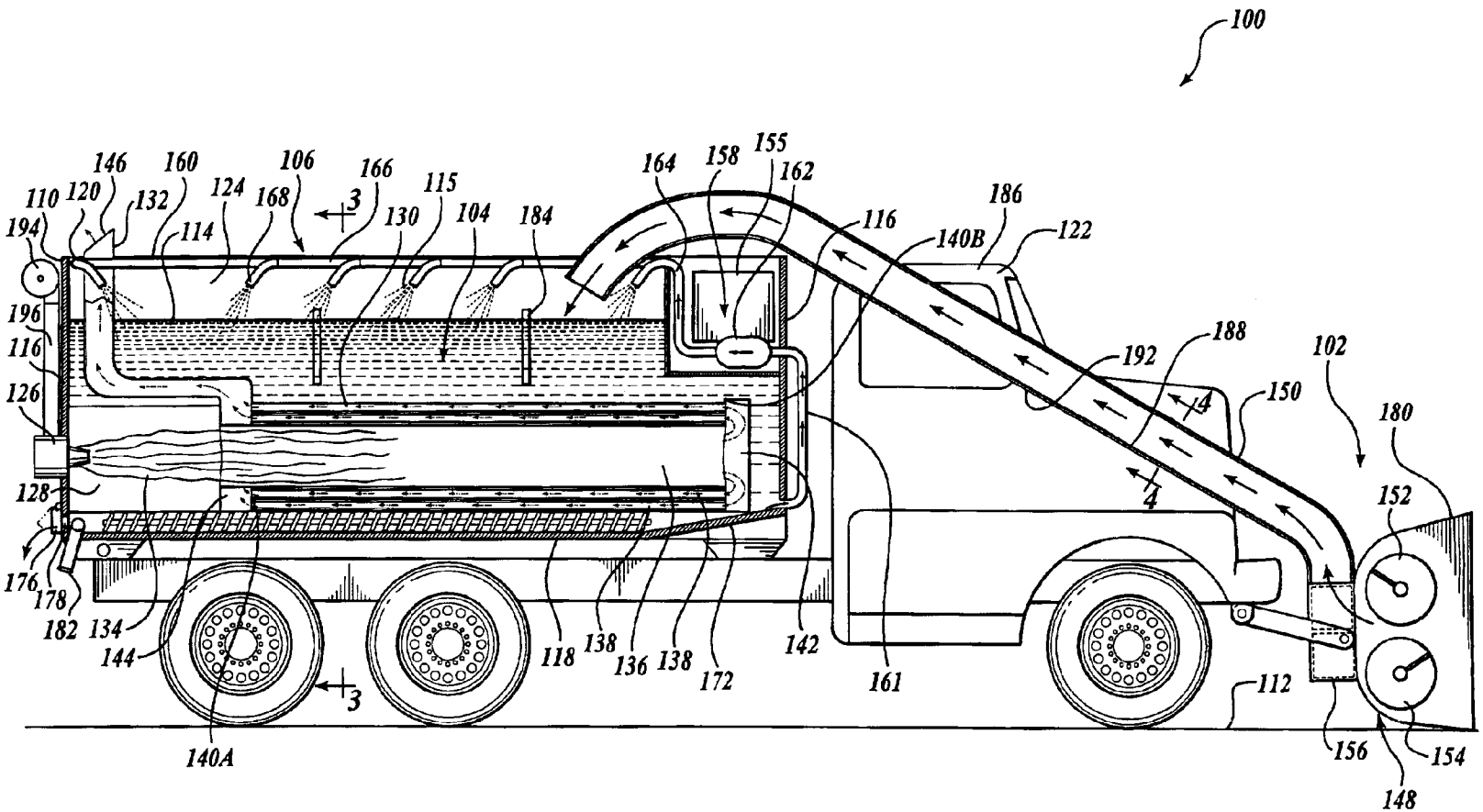
FIG. 1 is side elevation view of one embodiment of a snow removal system formed in accordance with the present invention wherein a container of the snow removal system is shown in cross-section to show a heating assembly and a mixing system disposed within the container.
Figure 2:
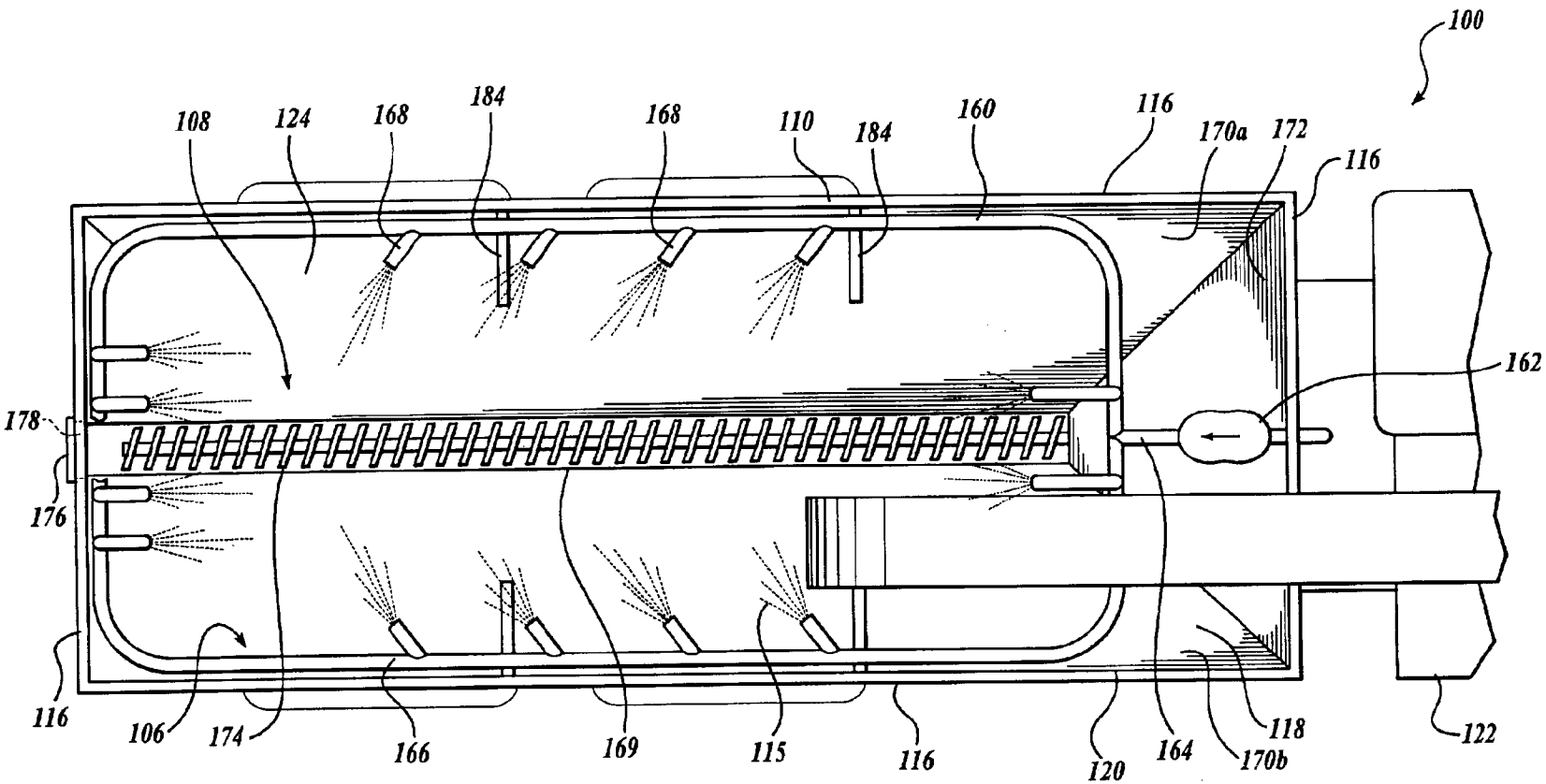
FIG. 2 is a top planar view of the snow removal system of FIG. 1, wherein the heating assembly and other components have been removed for clarity.
Figure 3:
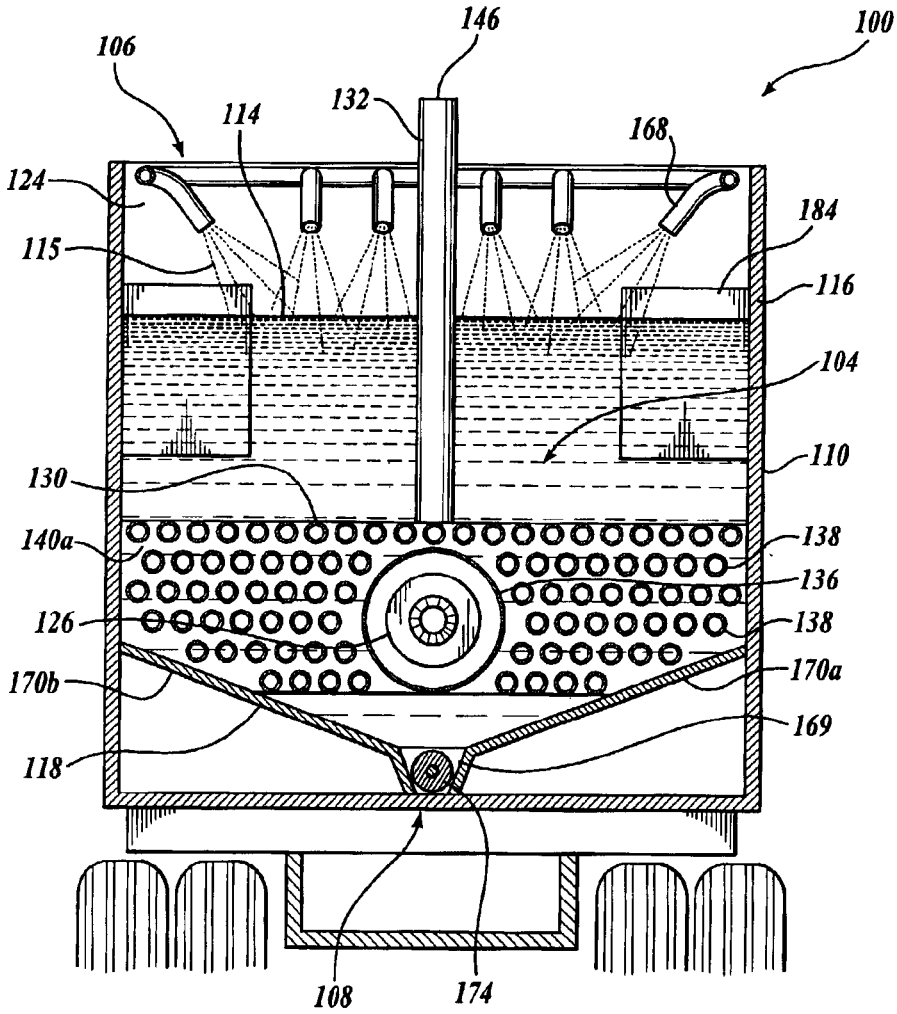
FIG. 3 is a cross-sectional view of the snow removal system of FIG. 1 taken substantially through Section 3—3 of FIG. 1.
Figure 4:
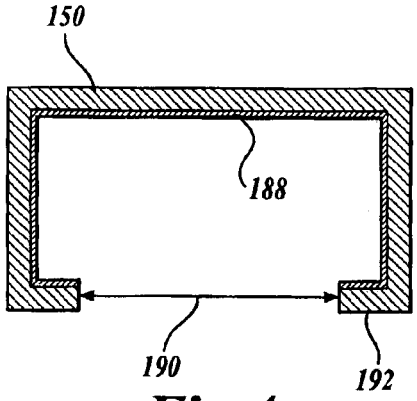
FIG. 4 is a cross-sectional view of a duct of a snow collection system of the snow removal system depicted in FIG. 1, the cross-sectional cut taken substantially through Section 4—4 of FIG. 1.

Referring to FIGS. 1–3, the snow removal system 100 is designed to collect snow disposed upon a ground surface 112, such as a road or parking lot, and melt the collected snow into water 114 occupying a fraction of the volume of the collected snow. The water may then be disposed of by discharge into a catch basin, tanker, reclamation system, ground surface, etc.

Generally described, the snow removal system 100 includes a snow collection system 102, a heating assembly 104, a mixing system 106, a debris disposal device 108, and a container 110. The container 110 houses the heating assembly 104, mixing system 106, and debris disposal device 108. Further, the container 110 stores the collected snow as it is melted and a selected amount of heated water 114. The snow collection system 102 collects the snow from the ground surface 112 and deposits the collected snow into the container 110. The heating assembly 104 heats and maintains the temperature of the water 114. The mixing system 106 sprays a selected amount of the heated water 114 upon the snow discharged into the container 110 and into the heated water 114. The sprayed water 115 assists in melting the snow through direct contact with the snow and by agitating the water 114 to promote mixing, resulting in the rapid conversion of the collected snow into water. As the container 110 fills, excess water is discharged from the container 110. The container 110 may be formed from any rigid material, such as steel.

Focusing in greater detail upon the container 110, the container 110 is a rectangular hollow block structure having four side walls 116, a bottom surface 118, and an open top 120. The container 140 is adapted to couple to a vehicle 122, such as a truck. Although the container 110 is depicted and described as being a hollow block structure, it should be apparent that the container 110 may be formed in any suitable manner, such as to have a rounded cross-section or to have a closed top surface in lieu of the open top 120.

Further, although the container 110 in the illustrated embodiment of the present invention is depicted as coupled to the vehicle 122 and in communication with the snow collection system 102 coupled to the vehicle 122, it should be apparent to those skilled in the art that the snow removal system 102 may be alternately formed. More specifically, it should be apparent to those skilled in the art that the container 110 may be adapted to be a stationary object, wherein the collected snow is deposited into the container 110 by a separate device, such as a front end loader or a dump truck (not shown). Further still, it should be apparent to those skilled in the art that the snow collection system 102 may be separated from the container 110 such that the container 110 is disposed upon a first vehicle or trailer and the snow collection system 102 is disposed upon a second vehicle that either tows the first vehicle or trailer or operates in proximity to the first vehicle or trailer, discharging collected snow into the container 110.

The container 110 further includes a storage chamber 124, the storage chamber 124 defined as the portion of the container 110 adapted to store collected snow and/or water. The volume of the container 110 is greater than the volume of the storage chamber 124 due to the presence of various components in the container 110 which are not adapted to receive collected snow and/or water 114, most notably of which are portions of the heating assembly 104. In the illustrated embodiment, the storage chamber 124 is adapted to hold 1,100 gallons at a selected minimum operating water level and is adapted to hold 2,800 gallons at a selected maximum operating water level. Therefore, the storage chamber 124 has a payload capacity of 1,700 gallons.

Disposed in the storage chamber 124 is a baffle assembly comprising four laterally oriented baffles 184. The baffles 184 extend outward perpendicularly from the two longitudinally oriented side walls 116. The baffles 184 terminate prior to reaching the centerline of the storage chamber 124 so as not to unduly inhibit mixing of the water 114. The baffles 184 aid in the reduction of the free surface effect of the water 114 contained in the storage chamber 124, especially during performance of braking and accelerating operations by the vehicle 122. Although the illustrated embodiment depicts four baffles 184, it should be apparent to those skilled in the art that other quantities of baffles are suitable for use with the present invention.

Focusing in greater detail upon the snow collection system 102, the snow collection system 102 includes a well known snow blower 148 coupled to a conduit or duct 150. The snow blower 148 of the illustrated embodiment is manufactured by Erskine Manufacturing, located in Erskine, Minn., model number 960FM. The snow blower 148 includes an upper auger 152 and a lower auger 154 disposed in a bucket 180. The augers 152 and 154 are adapted to pulverize snow encountered by the augers. The snow blower 148 further includes an impeller (not shown) disposed in an impeller housing 156. The impeller imparts a selected velocity to the snow pulverized by the augers 152 and 154 and directs the snow through the duct 150.

The augers 152 and 154 and impeller (not shown) of the snow collection system 102 are powered by a well known hydraulic pump 155. In the illustrated embodiment, the hydraulic pump is manufactured by Sauer-Sundstrand Co., located in Ames, Ind., Model No. SOR130HF1C80R3F1F03 GBA. Although the augers 152 and 154 and impeller are illustrated and described as powered from a hydraulic pump 155, it should be apparent to those skilled in the art that the snow collection system 102 may be powered by any means currently known or to be developed. For instance, the snow collection system 102 may be powered by a well known Power Take-Off (PTO) device which would couple an engine of the vehicle 122 to the snow collection system 102 to power the snow collection system 102.

Referring to FIGS. 1–4, the duct 150 has a first end coupled to the impeller housing 156 and a second end directed to discharge into the storage chamber 124. The duct 150 passes on a lateral side of a cab 186 of the vehicle 122. More specifically, the duct 150 does not pass over a roof of the cab 186 but passes to the right or left of the cab 186. Preferably, the cab 186 is what is know in the industry as a half cab to better accommodate the passage of the duct 150 to the lateral side of the cab 186. Further still, preferably the inner surface of the duct is lined with a coating or layer 188 exhibiting a low coefficient of friction relative to snow to aid in the reduction of snow accumulation in the duct 150. In the illustrated embodiment, the layer 188 is formed from an ultra high density plastic (UHDP), or alternately an abrasive resistant urethane.

The duct 150 may include a gap 190 running longitudinally along a bottom surface 192 of the duct 150 between the opposite side walls of the duct 150. The gap 190 aids in reducing the accumulation of snow upon the bottom surface 192 of the duct 150. The momentum and velocity of the snow retains the snow in the duct 150 during normal operation. The gap 190 also permits air to enter the duct 150.

The illustrated snow blower 148 is rated at 750 tons of snow per hour at 640 revolutions per minute (RPM). It is contemplated that enhanced operation may be obtained by increasing the RPM of the snow blower, such as to about 750 RPM, to aid in the conveyance of the snow through the duct 150.

Although the illustrated embodiment depicts a duct 150 for assisting in the conveyance of snow from the impeller housing 156 to the storage chamber 124, it should be apparent that alternate snow conveyance means may be employed, such as a conveyor belt (not shown).

Referring to FIGS. 1–3, and focusing in greater detail upon the heating assembly 104, the heating assembly 104 includes a burner mechanism 126, a combustion chamber 128, a heat exchanger 130, and an exhaust pipe 132. The burner mechanism 126 may be any suitable heated gas generating device known in the art. In the illustrated embodiment, the burner mechanism 126 is a well known diesel fired burner manufactured by Hauck, located in Lebanon, Pa., model number BBO 1108.

The illustrated burner mechanism 126 is operable to generate 8 million British Thermal Units (BTUs) per hour through mixing and combusting diesel with air. Fuel consumption of the illustrated embodiment is estimated at approximately 20 to 35 gallons per hour. Inasmuch as design and operation of the burner mechanism 126 is well known, it shall not be described in further detail herein for the sake of brevity. As should be apparent to those skilled in the art, the rated thermal capacity of the burner mechanism 126 may be varied depending upon the design conditions of the snow removal system 100. For instance, the rated thermal capacity is selected to provide a sufficient thermal output to melt a selected amount of snow per hour, usually measured in tons per hour, the snow having a selected temperature, using a heat exchanger 130 having a selected efficiency, and with a selected rate of heat loss to the outside environment.

A blower 194 is coupled to the burner mechanism 126 by a duct 196. The blower 194 provides a suitable quantity of air for combustion. In the illustrated embodiment, the blower 194 is a turbo blower manufactured by Hauck located in Lebanon, Pa., Model-No. TBAB1-080-290-E-(1) CY.

The burner mechanism 126 discharges pressurized air and fuel into the combustion chamber 128. The air and fuel mixture is combusted in the combustion chamber 126, producing products of combustion 134 at an elevated temperature. The products of combustion flow through the heat exchanger 130, wherein the heat contained in the products of combustion 134 is transferred to the water 114.

Although the illustrated burner mechanism 126 is described as a diesel fuel source burner, it should be apparent to those skilled in the art that the burner mechanism 126 may be modified to accept alternate fuel sources, such as other hydrocarbon fuel sources, solid fuels sources, such as pulverized coal, etc. Further, although the illustrated embodiment is depicted with a single burner mechanism 126, it should be apparent to those skilled in the art that multiple burner mechanisms are suitable for use and within the spirit and scope of the present invention. Further still, although a combustible heat source is depicted and described with relation to the illustrated embodiment, it should be apparent to those skilled in the art that alternate heat sources are suitable for use and within the spirit and scope of the present invention, such as electric heating coils, steam coils, etc.

The heat exchanger 130 includes a plurality of passageways including a primary fire tube 136 and an array of secondary fire tubes 138 disposed between two end plates 140*a* and 140*b*. The diameter of the primary fire tube 136 is substantially larger than the diameter of the secondary fire tubes 138. For instance, in the illustrated embodiment, the diameter of the primary fire tube 136 is 11 times greater than the diameter of the secondary fire tubes 138. The gas flow capacity of the primary fire tube 136 is sized to substantially match the gas flow capacity of all of the secondary fire tubes 138 combined. The secondary fire tubes 138 are disposed about the primary fire tube 136.

During normal operation, the products of combustion 134 exit the combustion chamber 128 as they pass through the primary fire tube 136 and into a first end chamber 142 of the heat exchanger 130, the first end chamber 142 formed in part by the end plate 140B. The products of combustion 134 change direction and enter the secondary fire tubes 138 from the first end chamber 142 and head towards the rear of the vehicle 122. The products of combustion 134 are discharged from the secondary fire tubes 138 into a second end chamber 144 of the heat exchanger 130, the second end chamber formed in part by the end plate 140A. The products of combustion 134 are discharged from the second end chamber 144 through an exhaust pipe 132. The exhaust pipe 132 passes horizontally through the storage chamber 124 for a selected length and then transitions to a vertical orientation, terminating at an exhaust tip 146 located outside of the container 110. The outer surfaces of the primary fire tube 136, secondary fire tubes 138, and the exhaust pipe 132 are all in contact with the water 114 to promote heat transfer between the products of combustion 134 and the water 114.

Although the heat exchanger 130 is depicted as a two-pass fire tube heat exchanger, it should be apparent to those skilled in the art that the heat exchanger may take many forms. For instance, it may be a single pass fire tube boiler or a water tube boiler. Or alternately, a plurality of primary fire tubes may replace the single primary fire tube 136 of the illustrated embodiment.

Focusing in greater detail upon the mixing system 106, the mixing system 106 includes a fluid pressurization system 158 and a fluid delivery system 160. The fluid pressurization system 158 includes a suction pipe 161 in fluid communication with the storage chamber 124 and an inlet of a pump 162. An outlet of the pump 162 is coupled to a discharge pipe 164. The pump 162 may be any well known pump now known or to be developed. In the illustrated embodiment, the pump is manufactured by Mission, located in Houston, Tex., Model No. 3-4R, Figure No. C5660, and Moduler No. 4605-90-30. In the illustrated embodiment, the pump 162 is adapted to discharge approximately 870 gallons per min (GPM) through an array of nozzles 168 at a pressure of about 18 psi.

The discharge pipe 164 is coupled in fluid communication with the fluid delivery system 160. The fluid delivery system 160 includes a delivery pipe 166 coupling the array of nozzles 168 in communication with one another. The delivery pipe 166 is disposed near the perimeter of the open top 120 of the container 110. The nozzles 168 are oriented to discharge pressurized water 115 into the storage chamber 124. Preferably, the nozzles 168 are disposed above a selected normal operating water level of the water 114, however, it should be apparent to those skilled in the art that the nozzles 168 may be disposed below the normal operating water level such that the tips of the nozzles 168 are submersed during normal operation.

Focusing in greater detail upon the debris disposal device 108, the debris disposal device 108 includes a sloped bottom surface 118. The sloped bottom surface 118 is inclined to direct debris that settles upon the bottom surface 118 to a channel 169 disposed longitudinally along the centerline of the bottom surface 118. The sloped bottom surface 118 includes two side panels 170*a* and 170*b*. Each side panel

170*a* and 170*b* is sloped laterally toward the channel 169. The sloped bottom surface 118 further includes an end panel 172. The end panel 172 is sloped in the longitudinal direction toward a proximal end of the channel 169.

Disposed in the channel 169 is an auger 174. The auger 174 may be rotated by any well known means such that debris present in the channel 169 is directed toward a debris discharge door 176 disposed at a distal end of the channel 169. The debris discharge door 176 is pivotable between a closed position and an open position. In the closed position, the discharge door 176 substantially seals against the container 110 to impede water 114 and debris from discharging from the storage chamber 124. In the open position, the discharge door 176 is pivoted away from the container 110 to permit water 114 to discharge through an aperture 178 in the container 110. As the water 114 runs through the aperture 178, the debris collected at the distal end of the channel 169 is suspended and carried out the aperture 178.

In light of the above description of the structural components of the snow removal system 100, the operation of the snow removal system 100 will now be described. Prior to snow removal, the storage chamber 124 is filled to a selected minimum operational water level such that at least the fire tubes 136 and 138 of the heat exchanger 130 are covered. In the illustrated embodiment, as mentioned above, the minimum operational water level is achieved when the 2,800 gallon storage chamber 124 contains 1,100 gallons. The burner mechanism 126 is utilized to burn a selected ratio of fuel and air in the combustion chamber 128, producing products of combustion 134 having an elevated temperature. The products of combustion pass through the primary fire tube 136, change direction and pass through the secondary fire tubes 138. Thus, the products of combustion 134 pass twice through the water 114 contained in the storage tank 124.

As the products of combustion 134 pass through the fire tubes 136 and 138 and the exhaust pipe 132, the heat contained in the products of combustion 134 is transferred to the water 114, heating the water 114 to a selected operating temperature. The selected operating temperature may range from 33 degrees Fahrenheit to 212 degrees Fahrenheit, with a preferred operating temperature of between about 50 degrees Fahrenheit to about 70 degrees Fahrenheit, with a more preferred operating temperature of 60 degrees Fahrenheit.

Once the water 114 is heated to operating temperature, or alternately before, the pump 162 is operated to circulate the water 114 contained in the storage chamber 124 through the nozzles 168. The pressurized water 115 discharged through the nozzles 168 agitates and mixes the water 114 disposed in the storage chamber 124. As the vehicle 122 moves forward, the bucket 180 scoops up snow disposed on the ground surface 112 and directs the snow into the augers 152 and 154. The augers 152 and 154 pulverize the snow and direct the pulverized snow into the impeller housing 156, wherein an impeller (not shown) imparts a high velocity to the collected snow, forcing the snow through the duct 150 and into the container 110.

As the snow is discharged into the container 110, the pressurized water 115 discharged from the nozzles 168 impacts the snow and water 114, mixing the incoming snow rapidly with the heated water 114. The mixing of the snow with the heated water 114 results in the rapid heating of the snow, removing the snow's latent heat of fusion to transform the snow from a solid to a liquid. The process continues until the storage chamber 124 reaches a maximum capacity, which in the illustrated embodiment is achieved when the water level reaches or nearly reaches the open top 120 of the container 110. As stated above, the maximum capacity occurs when the storage container contains about 2,800 gallons of water 114.

To discharge water 114 from the storage chamber 124, either the discharge door 176 may be positioned in the open position or a drain port 182 in fluid communication with the storage chamber 124 may be opened. The discharge door 176 and/or drain port 182 may be positioned so as to discharge the excess water to a catch basin, ground surface, water reclamation system, etc., until the water level is brought back down to the minimum operating water level. The debris disposal device 108 may be operated on an as needed basis to remove debris from the storage chamber 124.

As should be apparent to those skilled in the art, the illustrated embodiment may include an automatic control system (not shown) for controlling the operating parameters of the snow removal system 100 For instance, the automatic control system may include a water level sensor, high and low water sensors alarms, a water temperature sensor, high and low water temperature alarms, burner mechanism controls, water pressure sensor, high and low water pressure alarms, etc. Further, the automatic control system may include various additional controls to control the operation of the snow collection system 102, heating assembly 104, mixing system 106, debris disposal device 108, etc. Inasmuch as the design and operation of automatic control systems are well known in the art, the description of the automatic control system will not be described further herein. The control system used in one actual embodiment of the present invention was provided by Ponder Burner Company located in Washougal, Wash.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A snow removal system for melting snow into water comprising:

(a) a container having a storage chamber adapted to store snow and a predetermined amount of water;

(b) a heating assembly at least partially disposed in the storage chamber and adapted to generate heated gases to heat water stored in the storage chamber to a selected temperature, wherein the heated gases pass a first time through the storage chamber in a substantially submerged primary passageway and a second time through the storage chamber in a plurality of substantially submerged secondary passageways such that the heated gases do not directly contact the water stored in the storage chamber; and (c) a mixing system adapted to pressurize water and discharge the pressurized water through at least one nozzle, the nozzle oriented to direct the pressurized water into the storage chamber.

2. The snow removal system of claim 1 further comprising a snow collecting system coupled in communication with the container, the snow collection system adapted to collect snow from a ground surface and discharge the snow into the container.

3. The snow removal system of claim 1, wherein the secondary passageways are disposed about the primary passageway in the storage chamber.

4. The snow removal system of claim 3, wherein an exhaust pipe is coupled to the passageways to receive the heated gases passing through the passageways, the exhaust pipe at least partially disposed in the storage chamber so as to be at least partially submerged in the predetermined amount of water when present in the storage chamber.

5. The snow removal system of claim 1, wherein the storage chamber includes a bottom surface sloped to consolidate debris in the storage chamber in a selected location and a door disposed in a wall of the storage chamber, the door positionable between an open position in which the debris is permitted to discharge the storage chamber and a closed position in which the door impedes the discharge of the debris from the storage chamber.

6. The snow removal system of claim 1, wherein the container includes a bottom surface sloped to consolidate debris in the container in a channel disposed in the bottom surface, the channel having a debris removal device disposed therein.

7. The snow removal system of claim 6, wherein the debris removal device is an auger rotationally disposed within the channel.

8. The snow removal system of claim 1, wherein the nozzle is disposed above a preselected normal operating water level of water in the storage chamber.

9. The snow removal system of claim 1, wherein the mixing system includes a plurality of nozzles disposed near a perimeter of the storage chamber such that the plurality of nozzles are closer to the perimeter of the storage chamber than a center of the storage chamber.

10. The snow removal system of claim 1, further including at least one baffle disposed in the storage chamber, the baffle adapted to reduce a free surface effect of any water present in the storage chamber.

11. The snow removal system of claim 10, wherein the baffle is substantially laterally oriented in the storage chamber.

12. The snow removal system of claim 11, wherein the baffle extends outward from a longitudinally oriented sidewall of the storage chamber toward a centerline of the storage chamber, the baffle terminating prior to reaching the centerline of the storage chamber.

13. A snow removal system for collecting and melting snow into water comprising:

(a) snow collecting means for collecting snow from a ground surface and conveying the collected snow to a storage chamber adapted to store the collected snow and water produced from melted snow;

(b) heating means at least partially disposed in the storage chamber for heating the water by heat transfer between the water and a heated gas passing a first time through the storage chamber in a substantially submerged primary passageway and a second time through the storage chamber in a plurality of substantially submerged secondary passageways without the heated gas directly contacting the water; and (c) mixing means for mixing the contents of the storage chamber by discharging pressurized water into the storage chamber.

14. The snow removal system of claim 13, wherein the secondary passageways are disposed about the primary passageway in the storage chamber.

15. The snow removal system of claim 14, wherein the heating means includes an exhaust pipe coupled to the passageways to receive the heated gas passing through the passageways, the exhaust pipe disposed in the storage chamber so as to be at least partially submersed in the contents of the storage chamber.

16. The snow removal system of claim 13, wherein the storage chamber includes a bottom surface sloped to consolidate debris in the storage chamber in a selected location and a door disposed in a wall of the storage chamber, the door positionable between an open position in which the debris is permitted to discharge from the storage chamber and a closed position in which the door impedes the discharge of the debris from the storage chamber.

17. The snow removal system of claim 13, wherein the storage chamber includes a bottom surface sloped to consolidate debris in a channel, the channel having a debris removal device disposed therein.

18. The snow removal system of claim 17, wherein the debris removal device is an auger rotationally disposed within the channel.

19. The snow removal system of claim 13, wherein the mixing means includes a pressurized water source coupled in communication with at least one nozzle, the nozzle oriented to discharge a fluid into the storage chamber.

20. The snow removal system of claim 13, further including a baffle means disposed in the storage chamber for reducing a free surface effect of a liquid when present in the storage chamber.

21. A method of snow removal comprising:

(a) collecting snow from a ground surface;

(b) discharging the collected snow into a container containing heated water heated by a heated gas passing a first time through the storage chamber in a substantially submerged primary passageway and a second time through the storage chamber in a plurality of substantially submerged secondary passageways such that the heated gas does not directly contact the heated water; and (c) mixing the collected snow with the heated water in the container by discharging pressurized water into the container to mix the heated water and collected snow to assist in melting the collected snow.

22. The method of claim 21 further comprising heating the heated water to maintain the heated water at a predetermined temperature by burning a fuel to produce the heated gas and passing the heated gas through the primary passageway and through the secondary passageways disposed about the primary passageway.

23. The method of claim 21, further comprising directing an exhaust pipe coupled to the passageways through the heated water.

24. The method of claim 21, further comprising collecting debris disposed in the container by sloping a bottom surface of the container to a channel and moving a driven surface through the channel to move collected debris from a first location to a second location.

25. The method of claim 21, further comprising collecting debris disposed in the container by sloping a bottom surface of the container to a selected location, and further comprising selectively controlling a configuration of a door disposed adjacent to the selected location between an open position in which the debris is permitted to leave the container and a closed position in which the door impedes the debris from leaving the container.

26. The method of claim 21, wherein the vehicle has a cab and wherein the snow collecting means includes a snow blower and a conduit extending between the snow blower and the container for aiding in conveying snow from the snow blower to the container, the conduit oriented so as to pass to a lateral side of the cab.

27. The method of claim 21, further comprising discharging the pressurized water from a series of nozzles disposed above a selected normal operating water level of the heated water in the container.

28. The snow removal system of claim 1, wherein a gas flow capacity of the primary passageway substantially equals a combined gas flow capacity of the secondary passageways.

29. The snow removal system of claim 13, wherein a gas flow capacity of the primary passageway substantially equals a combined gas flow capacity of the secondary passageways.

30. The method of snow removal of claim 21, wherein a gas flow capacity of the primary passageway substantially equals a combined gas flow capacity of the secondary passageways.

31. A snow removal system for melting snow into water comprising:

(a) a container having a storage chamber adapted to store snow and a predetermined amount of water, wherein the container includes a bottom surface sloped to consolidate debris in the container in a channel disposed in the bottom surface, the channel having an auger rotationally disposed within the channel;

(b) a heating assembly at least partially disposed in the storage chamber and adapted to generate heated gases to heat water stored in the storage chamber to a selected temperature; and (c) a mixing system adapted to pressurize water and discharge the pressurized water through at least one nozzle, the nozzle oriented to direct the pressurized water into the storage chamber.

32. A snow removal system for melting snow into water comprising:

(a) a container having a storage chamber adapted to store snow and a predetermined amount of water;

(b) a at least one baffle adapted to reduce a free surface effect of any water present in the storage chamber, the baffle extending laterally outward from a longitudinally oriented sidewall of the storage chamber toward a centerline of the storage chamber, the baffle terminating prior to reaching the centerline of the storage chamber;

(c) a heating assembly at least partially disposed in the storage chamber and adapted to generate heated gases to heat water stored in the storage chamber to a selected temperature; and (d) a mixing system adapted to pressurize water and discharge the pressurized water through at least one nozzle, the nozzle oriented to direct the pressurized water into the storage chamber.

33. A snow removal system for collecting and melting snow into water comprising:

(a) snow collecting means for collecting snow from a ground surface and conveying the collected snow to a storage chamber adapted to store the collected snow and water produced from melted snow, wherein the storage chamber includes a bottom surface sloped to consolidate debris in a channel, the channel having an auger rotationally disposed within the channel;

(b) heating means at least partially disposed in the storage chamber for heating the water by heat transfer between a heated fluid; and (c) mixing means for mixing the contents of the storage chamber by discharging pressurized water into the storage chamber.

* * * * *

UNITED STATES PATENT AND TRADEMARK OFFICE

CERTIFICATE OF CORRECTION

PATENT NO. : 6,904,708 B2
DATED : June 14, 2005
INVENTOR(S) : G. A. Rogers

It is certified that error appears in the above-identified patent and that said Letters Patent is hereby corrected as shown below:

Column 9,
Line 5, "submerged" should read -- submersed --.

Signed and Sealed this

Twenty-ninth Day of November, 2005

JON W. DUDAS
*Director of the United States Patent and Trademark Office*